US006349778B1

(12) United States Patent
Blair et al.

(10) Patent No.: US 6,349,778 B1
(45) Date of Patent: Feb. 26, 2002

(54) INTEGRATED TRANSMITTER SURVEYING WHILE BORING ENTRENCHING POWERING DEVICE FOR THE CONTINUATION OF A GUIDED BORE HOLE

(75) Inventors: Paris E. Blair; Joseph L. Ficken; Daniel J. Richards, all of Casper, WY (US)

(73) Assignee: Performance Boring Technologies, Inc., Casper, WY (US)

( * ) Notice: Subject to any disclaimer, the term of this patent is extended or adjusted under 35 U.S.C. 154(b) by 0 days.

(21) Appl. No.: 09/617,189

(22) Filed: Jul. 14, 2000

Related U.S. Application Data

(60) Provisional application No. 60/174,487, filed on Jan. 4, 2000, and provisional application No. 60/203,040, filed on May 9, 2000.

(51) Int. Cl.[7] ..... E21B 25/16; E21B 47/02; E21B 7/09

(52) U.S. Cl. ..... 175/73; 175/45; 175/107

(58) Field of Search ..... 175/45, 73, 60, 175/62, 107; 73/152.43

(56) References Cited

U.S. PATENT DOCUMENTS

| | | | | |
|---|---|---|---|---|
| 4,241,796 | A | 12/1980 | Green et al. | 175/24 |
| 4,733,733 | A | 3/1988 | Bradley et al. | 175/45 |
| 4,779,852 | A | 10/1988 | Wassell | 267/125 |
| 4,821,563 | A | 4/1989 | Maron | |
| 4,828,050 | A | 5/1989 | Hashimoto | 175/45 |
| 4,907,658 | A | 3/1990 | Stangl et al. | 175/19 |
| 5,096,001 | A | 3/1992 | Buytaert et al. | 175/40 |
| 5,148,880 | A | 9/1992 | Lee et al. | 175/393 |
| 5,186,256 | A | 2/1993 | Downs | 166/272 |
| 5,242,026 | A | 9/1993 | Deken et al. | 175/62 |
| 5,253,721 | A | 10/1993 | Lee | 175/73 |
| 5,269,383 | A * | 12/1993 | Forrest | 175/26 |
| 5,311,951 | A | 5/1994 | Kyte et al. | 175/40 |
| 5,325,714 | A | 7/1994 | Lende et al. | |
| 5,341,887 | A | 8/1994 | Deken et al. | 175/62 |
| 5,382,760 | A | 1/1995 | Staron et al. | 181/121 |
| 5,392,868 | A | 2/1995 | Deken et al. | 175/62 |
| 5,456,106 | A | 10/1995 | Harvey et al. | |
| 5,560,437 | A | 10/1996 | Dickel et al. | 175/40 |
| 5,589,775 | A | 12/1996 | Kuckes | 324/346 |
| 5,646,611 | A | 7/1997 | Dailey et al. | 340/853.6 |
| 5,678,643 | A | 10/1997 | Robbins et al. | 175/45 |
| 5,679,894 | A | 10/1997 | Kruger et al. | 73/152.03 |
| 5,680,906 | A | 10/1997 | Andrieux et al. | 175/45 |
| 5,725,061 | A | 3/1998 | Van Steenwyk et al. | 175/104 |
| RE35,790 | E * | 5/1998 | Pustanyk et al. | 175/40 |
| 5,798,488 | A | 8/1998 | Beresford et al. | 181/102 |
| 5,812,068 | A | 9/1998 | Wisler et al. | 340/855.5 |
| 5,877,996 | A | 3/1999 | Krokstad et al. | 367/31 |
| 5,924,499 | A | 7/1999 | Birchak et al. | 175/40 |
| 5,931,240 | A * | 8/1999 | Cox | 175/73 |
| 5,934,391 | A * | 8/1999 | Cox | 175/73 |
| 5,950,743 | A | 9/1999 | Cox | 175/61 |
| 6,050,350 | A * | 4/2000 | Morris et al. | 175/45 |

* cited by examiner

*Primary Examiner*—David Bagnell
*Assistant Examiner*—Jennifer R. Dougherty
(74) *Attorney, Agent, or Firm*—Pearne & Gordon LLP

(57) ABSTRACT

A bottom hole assembly for horizontal directional drilling that improves the accuracy of surveying while boring by enabling the progress of the bore to be monitored and tracked with the aid of a sonde. In one embodiment the sonde is received in the wall of a area of a mud motor surrounding the bearing mandrel, in another embodiment the sonde is carried in the wall of a collar surrounding the bearing mandrel housing, and in an additional embodiment the sonde is carried in an adapter between the bearing mandrel and the bit.

7 Claims, 5 Drawing Sheets

INTEGRATED TRANSMITTER SURVEYING WHILE BORING ENTRENCHING POWERING DEVICE FOR THE CONTINUATION OF A GUIDED BORE HOLE

This application claims the priority of U.S. Provisional Application No. 60/174,487, filed Jan. 4, 2000 and U.S. Provisional Application No. 60/203,040, filed May 9, 2000.

BACKGROUND OF THE INVENTION

The invention relates to horizontal directional drilling and, in particular, to improvements in bottom hole assemblies for such drilling techniques.

PRIOR ART

Horizontal directional drilling methods are well known and can offer many advantages over traditional open trench digging operations. There remains a need for greater precision in monitoring and guiding the course of the hole as it is being bored. This need is particularly acute in utility easements and like corridors where pre-existing lines are located often without precision in their placement and "as built" records.

As used herein, the terms "sonde" and "monitoring/tracking device" are used interchangeably to mean a device known in the trenchless boring industry as a surveying device for the monitoring and tracking of a bore hole. The term "boring device" refers to equipment such as a rock tricone drill bit, a poly-diamond-crystalline (PDC) bit, or any other device known in the art to drill or lengthen a bore hole. Finally, the terms "entrenching powering device" and "mud motor" are used interchangeably for a device generally known in the art used to rotate a boring device, without turning the drill pipe/drill string, by some type of drilling rig to continue a hole or bore.

Known horizontal directional drilling bottom hole assemblies typically include a sonde that transmits electromagnetic signals indicating the pitch (from horizontal), the clock (roll about a horizontal axis clockwise or counterclockwise from a reference of say 12 o'clock), and the depth of the sonde. The sonde also enables a person sweeping the corridor with a receiver or detector to locate the horizontal or lateral position of the sonde in the specified corridor.

Because of limitations of current tooling, the transmitter/guidance system or sonde is ordinarily located a considerable distance away from the boring device when an entrenching powering device is used. The sonde may only be as close as about 20 feet and as far as about 50 feet from the boring device. This is due to the fact that an entrenching powering device has generally not been designed to integrate a sonde. The distance between the sonde and the boring device is a major concern for drillers in the utility business, especially when they encounter a job with very restrictive parameters in terms of drilling path.

The sonde transmits a signal that indicates where the sonde is located which can be 20 feet+behind the boring device. This type of drilling has been described as driving a car forward, from the back seat looking out the rear window. A driller only "sees" where he has already drilled, not where he is currently drilling. This becomes a major problem if the boring device veers off course and begins boring outside a designated corridor. The operator will not know there is a potential problem until the boring device is 20 feet+off course. If the driller waits longer to see if the boring device steers back on course, the boring device may continue even further off course. This causes a risk that the driller may destroy cable lines, gas lines, or the like and if such destruction occurs it is not only expensive but dangerous as well.

SUMMARY OF THE INVENTION

The invention provides an improved bottom hole assembly for horizontal directional drilling in which the sonde is carried ahead of the power section of the entrenching powering device or mud motor. In a presently preferred embodiment, the sonde is located in a pocket formed in the wall of a housing of the entrenching powering device that surrounds a bearing mandrel or bit driving shaft. More specifically, the sonde receiving pocket is nestled axially between thrust bearings supporting the mandrel and a flex shaft transmission that couples the power section to the mandrel. This forward location of the sonde greatly improves the accuracy of surveying while boring the hole so as to facilitate placement of the hole and ultimate line in the intended path.

The disclosed mounting arrangement for the sonde readily allows the sonde to be adjusted for a proper clock orientation and is somewhat resilient to limit vibrational forces transmitted to the sonde during operation.

Other mounting structures for the sonde are disclosed. Each of these structures offers improved boring accuracy over prior art constructions by enabling the sonde to be positioned relatively close to the boring device.

DESCRIPTION OF THE PREFERRED EMBODIMENTS

With reference particularly to FIGS. 1, 2A–2D, 5 and 6, parts towards the left are sometimes hereafter referred to as forward parts in the sense of the drilling direction, it being understood that in such figures, the drilling direction is to the left; the rearward or trailing end of such parts, conversely, is shown to the right. The forward direction can be equated with a downward direction and the rearward direction can be equated with an upper direction where drilling is vertical.

Figure 1:
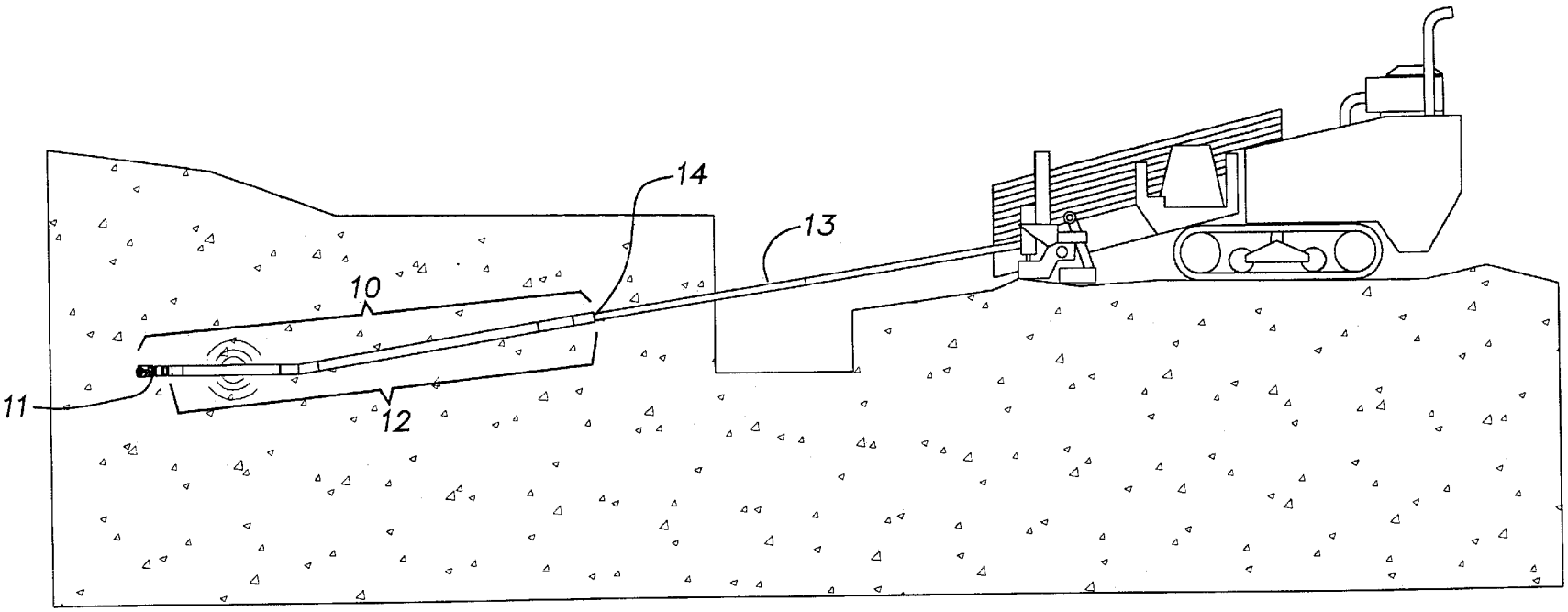
FIG. 1 is a side elevational view of a bottom hole assembly and a portion of a trailing drill string.
Figure 2A:
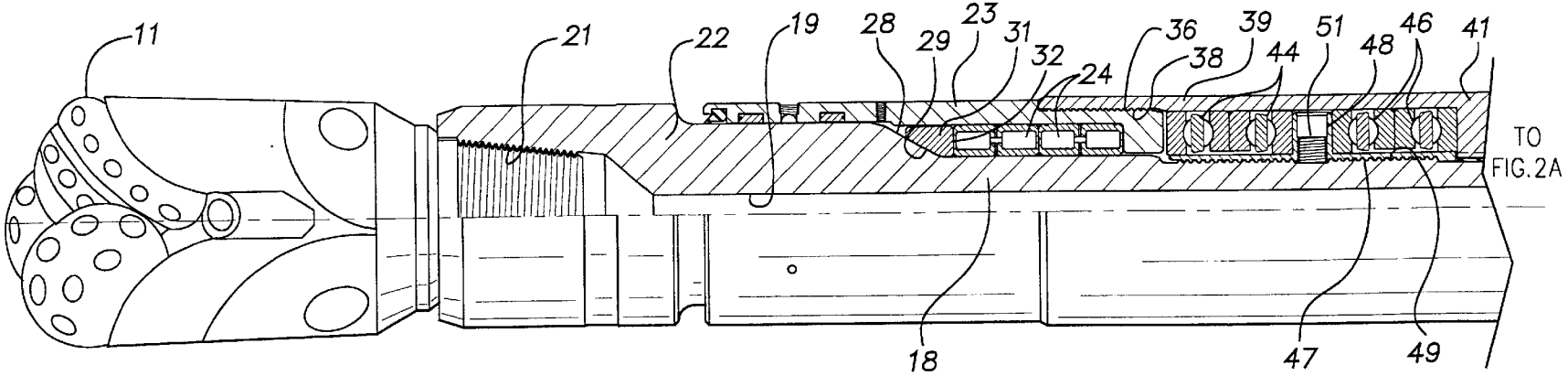
FIGS. 2A through 2D is a longitudinal cross sectional view of a mud motor constructed in accordance with the invention.
Figure 2B:
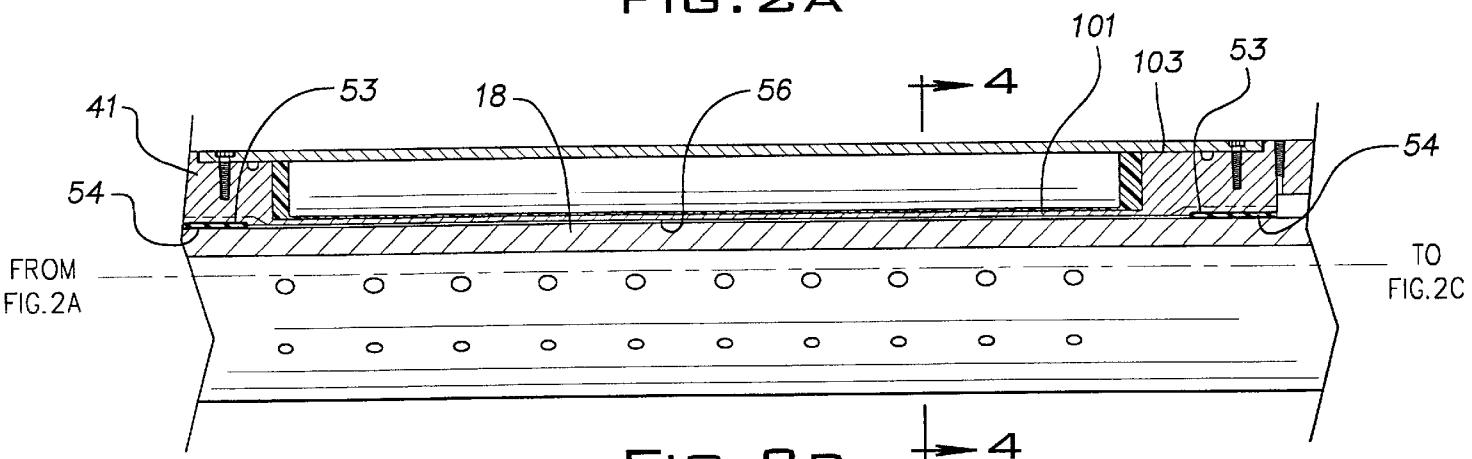
Figure 2C:
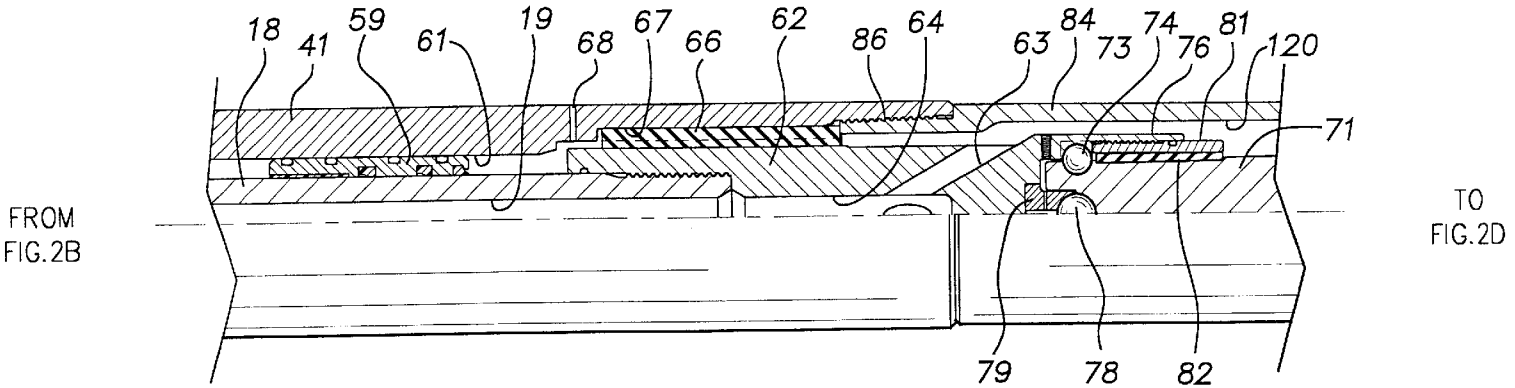
Figure 2D:
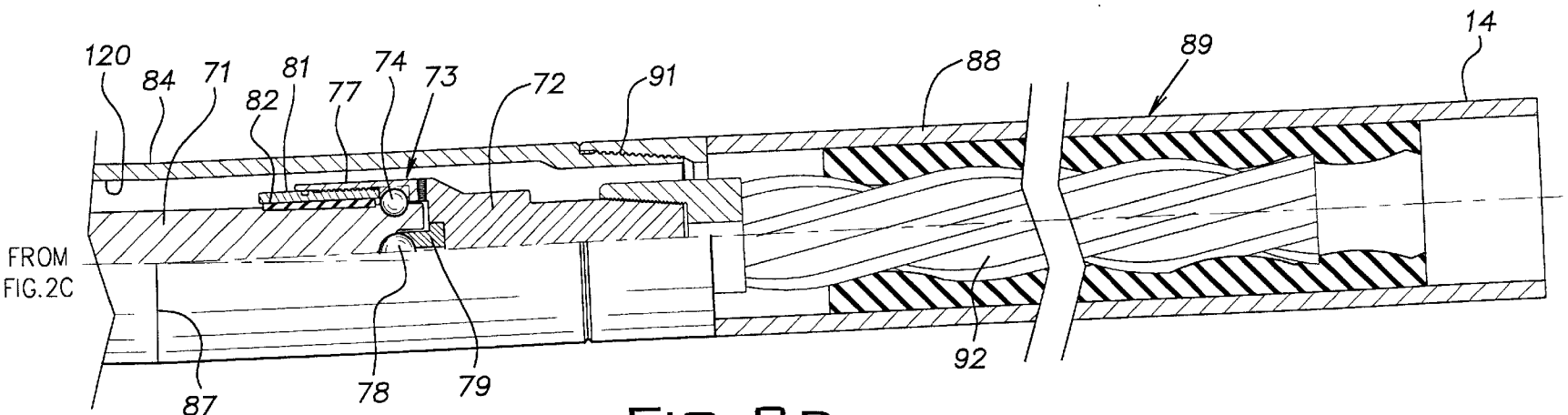

Referring now to FIG. 1, a bottom hole assembly 10 comprises a boring device or bit 11 and an entrenching powering device or mud motor 12 having its forward end carrying the bit 11. A drill string 13 is coupled to a trailing end 14 of the mud motor 12 in a conventional fashion.

The mud motor 12, as shown in FIGS. 2A–2D includes a hollow cylindrical bearing mandrel 18 having a central through bore 19. The bit 11 is coupled to a bit box 21 formed in the forward end of the bearing mandrel 18. Thus, the bearing mandrel 18 is enabled to drive the bit 11 in rotation and to transmit thrust from the drill string 13.

Adjacent its forward end 22, the bearing mandrel 18 is rotationally supported in a lower tubular cylindrical housing 23 by a set of radial bearings 24. A conical shoulder 28 of the bearing mandrel 18 is received in a conical bore 29 of a radial ring 31. A radial face of the ring 31 is arranged to abut an adjacent one of the set of radial bearings 24. Male threads 36 of the lower or forward housing 23 couple with female threads 38 in a forward end 39 of an elongated hollow circular outer housing 41.

Sets of thrust bearings 44, 46 are assembled on a carrier nut 47 at opposite sides of an annular flange 48. The carrier nut 47 is threaded onto an externally threaded part 49 of the bearing mandrel 18. The carrier nut 47 is locked in position on the bearing mandrel 18 by set screws 51 spaced about the periphery of the flange 48.

Sleeve bearings 53, of suitable self-lubricating material such as the material marketed under the registered trademark DU® are received in counterbores 54 formed in the outer housing 41 and serve to rotationally support the mid and trailing length of the bearing mandrel 18. A longitudinal bore 56 in the surrounding outer housing 41 provides clearance for the main length of the bearing mandrel 18.

An annular piston 59 floats on a rearward part of the mandrel 18 in a counterbore 61 in the outer housing 41. The piston 59 retains lubricant in the annular zones of the bearings 53, 44 and 46. A circular bearing adapter 62 is threaded onto the rear end of the bearing mandrel 18. A plurality of holes 63 distributed about the circumference of the adapter 62 are angularly drilled or otherwise formed in the adapter to provide mud flow from its exterior to a central bore 64 of the adapter. As shown, the central bore 64 communicates directly with the bore 19 of the bearing mandrel 18. The bearing adapter 62 is radially supported for rotation in a sleeve-type marine bearing 66 assembled in a counter bore 67 in a rear portion of the outer housing 41. Ports 68 allow flow of mud through the marine bearing 66 for cooling purposes.

A flex shaft 71 rotationally couples a rotor adapter 72 to the bearing adapter 62. At each end of the flex shaft 71 is a constant velocity universal joint 73 comprising a series of circumferentially spaced balls 74 seated in dimples in the flex shaft and in axially extending grooves in a skirt portion 76 of the bearing adapter 62 or skirt portion 77 of the rotor adapter 72. Each coupling or universal joint 73 also includes a ball 78 on the axis of the flex shaft and a ball seat 79 received in the respective bearing adapter 62 or rotor adapter 72. Each universal joint 73 includes a bonnet 81 threaded into each of the skirts 76 or 77 to retain the joints or couplings 73 in assembly. Cylindrical elastomeric sleeves 82 are disposed within each of the bonnets 81 to retain grease in the area of the balls 74, 78 and to exclude contamination from this area. A cylindrical tubular flex housing 84 surrounds the flex shaft 71 and is fixed to the rear end of the outer housing 41 by threading it into the latter at a joint 86. The flex housing 84 is bent at a mid plane 87 such that the central axis at its rear end is out of alignment with its central axis at its forward end by a small angle of, for example, 2°. At its rearward end, the flex housing 84 is fixed to the stator or housing 88 of a power section 89 of the mud motor 12 by a threaded joint 91. The stator 88 is a hollow internally fluted member in which operates an externally fluted rotor 92. The power section 89 formed by the stator 88 and rotor 92 are of generally known construction and operation. The rotor adapter 72 is threaded into the forward end of the rotor 92 to rotationally couple these members together. The drill string 13 is threaded on the rear end of the stator with or without the use of an adapter. The flex shaft 71 converts the rotational and orbital motion of the rotor 92 into plain rotation of the bearing mandrel 18.

Figure 4:
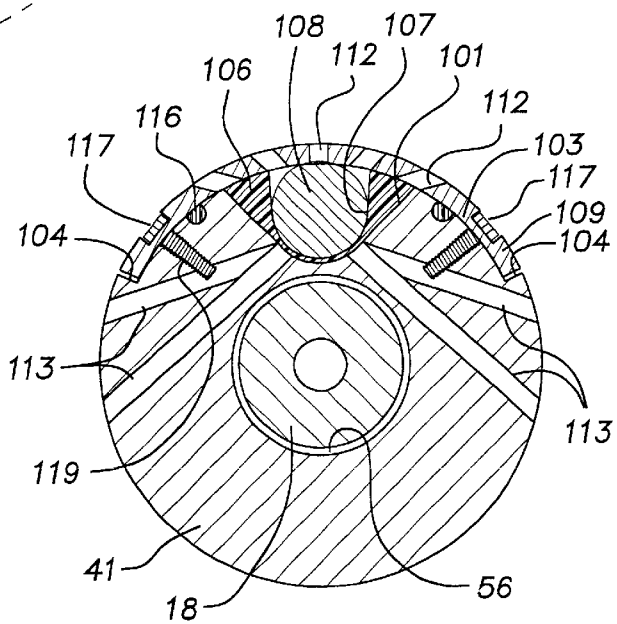
FIG. 4 is a transverse cross sectional view of the mud motor taken in the plane 4—4 indicated in FIG. 2B.
Figure 3:
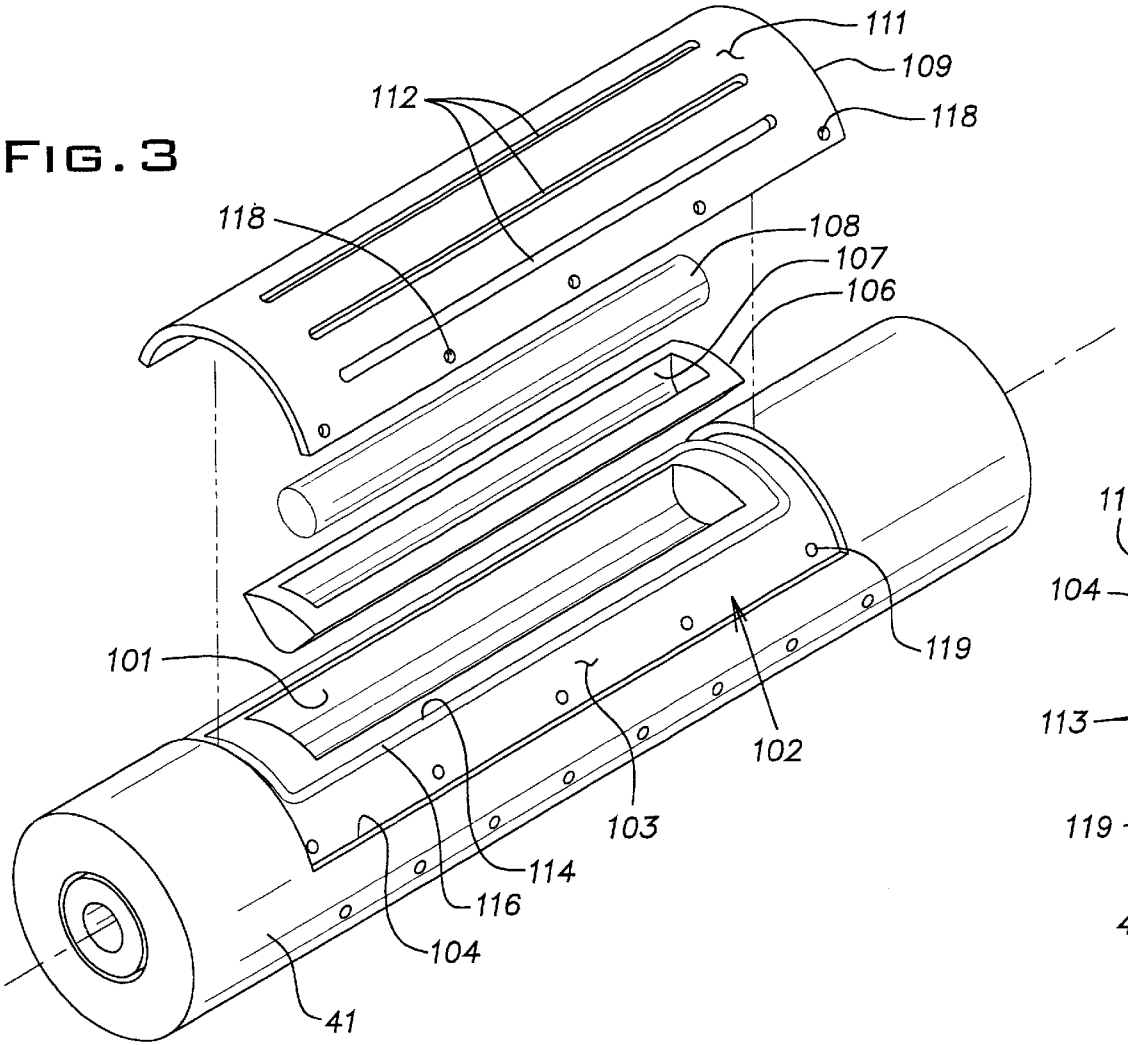
FIG. 3 is a fragmentary perspective exploded view of a portion of the mud motor and the sonde.

Referring particularly to FIGS. 3 and 4, the outer housing 41 is formed with a pocket or elongated recess 101 rearward of the thrust bearing units 44, 46. The pocket 101 is milled or otherwise cut out of the wall of the outer housing 41 with an included angle of 90° in the plane of FIG. 4 transverse to the longitudinal axis of the housing 41. Surrounding the pocket 101 is a relatively shallow seat or recess 102 similarly cut into the wall of the housing 41. When viewed in the plane of FIG. 4, this seat has a cylindrical arcuate surface area 103 concentric with the axis of the housing 41 and radially extending surfaces 104.

An elastomeric sarcophagus 106 of polyurethane or other suitable material has exterior surfaces generally conforming to the surfaces of the pocket 101. The sarcophagus 106 is configured with a round bottom slot 107 for receiving a sonde 108. More specifically, the slot 107 is proportioned to receive a standard commercially available sonde of a size which, for example, can be 1¼" diameter by 19" long. It is understood that the sarcophagus may be configured with a slot to fit sondes of other standard sizes such as 1" diameter by 8" long or a secondary sarcophagus may be provided to increase the effective size of a smaller sonde to that of the larger size. An arcuate cover plate 109 of steel or other suitable material is proportioned to fit into the area of the seat 102 to cover and otherwise protect the sonde 108 from damage during drilling operations. The cover 109 is proportioned, when installed in the seat 102, to provide an outer cylindrical surface 111 that lies on the same radius as that of the outer cylindrical surface of the housing 41 surrounding the pocket or slot 101. The cover 109, is provided with a plurality of longitudinal through slots 112, to allow passage of electromagnetic signals transmitted from the sonde 108. The slots 112 are filled with non-metallic material such as epoxy to exclude contaminates from passing into the pocket 101 or otherwise reaching the sonde 108. Additionally, for purposes of allowing the sonde to transmit signals over a wide angle, the body of the housing 41 is drilled with holes 113 which are filled with epoxy or other non-metallic sealant. A shallow groove 114 is cut in a generally rectangular pattern in the surface 103 around the pocket 101 to receive an O-ring seal 116.

The round bottom slot or groove 107 in the sarcophagus is dimensioned to provide a friction fit with the sonde 108. This permits the sonde 108 to be rotated or rolled on its longitudinal axis to "clock" it by registering its angular orientation relative to the plane of the bend in the flex housing 84 as is known in the art.

The cover or plate 109 is retained in position over the sonde 108 by a plurality of screws 117 assembled through holes 118 in the cover and aligned with threaded holes 119 formed in the outer housing 41. The screw holes 118, 119 are distributed around the periphery of the cover 109. The O-ring 116 seals against the inside surface of the cover 109 to exclude contaminates from entering the pocket 101 during drilling operations.

The sarcophagus 106 is proportioned so that it is compressed by the cover 109 around the sonde 108 when the screws 117 draw the cover tight against the seat surface 103. This compression of the sarcophagus 106 increases its grip on the sonde 108 so that the sonde is locked in its adjusted "clocked" position. The elastomeric property of the sarcophagus 106, besides enabling it to resiliently grip the sonde when compressed by the cover 109, can serve to cushion the sonde 108 from excessive shock forces during drilling operation.

Other resilient mounting structures for the sonde 108 are contemplated. For example, the sonde 108 can be retained in the pocket 101 by resilient steel straps arranged to overlie the sonde as it lies in the pocket 101. The straps can be retained in place by suitable screws or other elements.

When the mud motor 12 is operated, mud or water passing between the stator 88 and rotor 92 travels through the transmission and bearing sections of the mud motor bounded by the flex housing 84, outer housing 41, and lower housing 23 and is delivered to the bit 11. More specifically, the mud flows through the annulus between the flex shaft 71 and an inner bore 120 of the flex housing 84. From this annulus, the mud enters the central bore 64 of the bearing adapter through the angularly drilled holes 63. The mud flows from this bore 64 through the axial bore 19 in the bearing mandrel 18.

From the foregoing description, it can be seen that the disclosed arrangement in which the sonde is received in the wall of a main housing part, namely the outer housing 41, the sonde can be disposed quite close to the bit 11 with minimal hardware and without complexity. As seen, the flow of mud from the power section 89 to the bit 11 is unrestricted and the diameter of the transmission section is not unnecessarily enlarged beyond that which is already required for the necessary bearings and other componentry. By locating the sonde 108 close to the bit 11, much greater accuracy in monitoring and tracking the progress of the boring process over that possible with the prior art is achieved.

Operation of the mud motor to steer the pipe string along its desired path will be evident to those skilled in the art. Typically, to adjust the direction of the bore, the drill string is rotated to point the bit in the direction of the needed adjustment. The orientation of the bit is transmitted to a surface receiver by the sonde. The drill string is held against rotation while the mud motor rotates the bit and the drill string is thrust forward to redirect the direction of the bore. The disclosed mud motor provides a unique function that is enabled by the provision of the forward set of thrust bearings 44. These bearings 44 allow the mud motor to operate to rotate the bit 11 when the drill string is being pulled out of the hole so that during this withdrawal process the hole is conveniently reamed or enlarged with a hole opening device.

Figure 5:
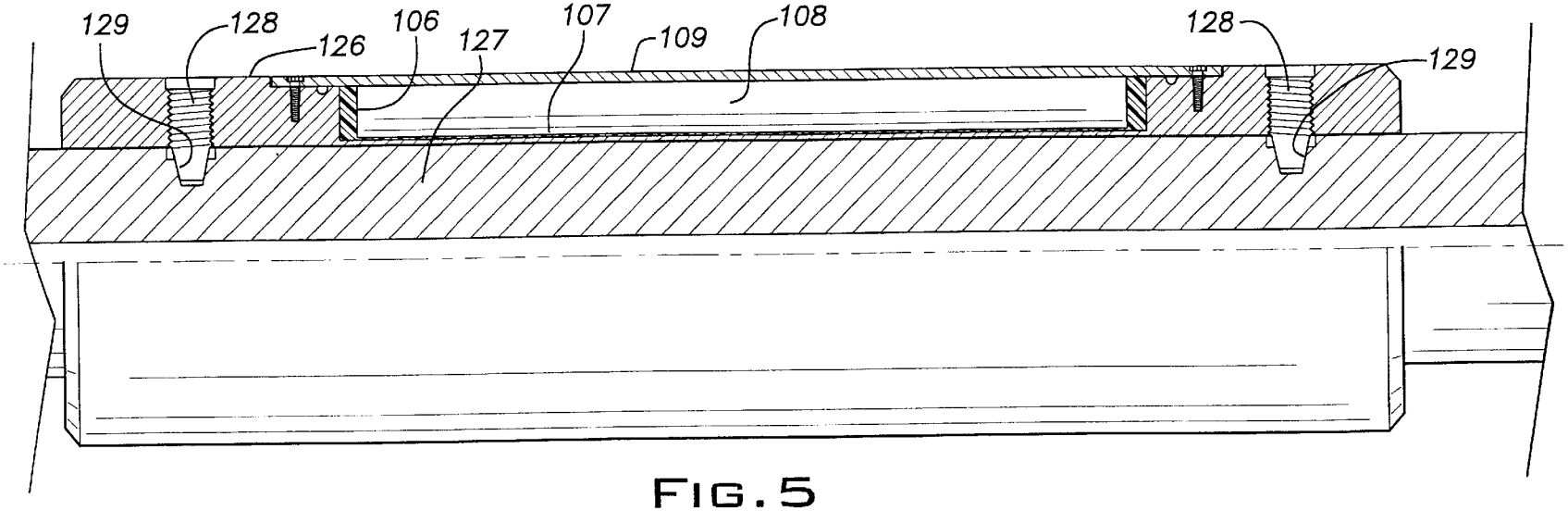
FIG. 5 is a side view, partially in section, of a second embodiment of the invention.
Figure 6:
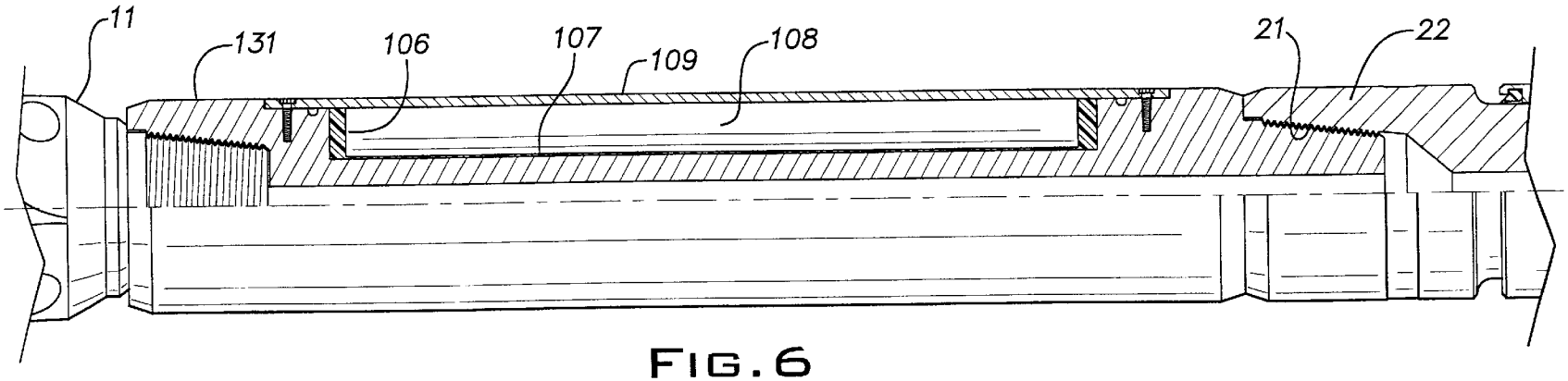
FIG. 6 is a side view, partially in section, of a third embodiment of the invention.

FIGS. 5 and 6 illustrate additional embodiments of the invention. Parts like those described in connection with the embodiment of FIGS. 1–4 are designated with the same numerals. In FIG. 5, a tubular cylindrical collar 126 housing the sonde 108 is assembled around a housing 127 that corresponds to the outer housing 41 of the embodiment of FIGS. 1–4. The collar 126 is formed of steel or other suitable material. The collar 126 is fixed longitudinally and angularly relative to the housing 127 by set screws 128 threaded into the wall of the collar 126 and received in blind holes 129 drilled in the wall of the housing 127. The sonde 108 is received in the sarcophagus 106 and protected by the cover 109 as previously described. Various other techniques, besides the set screws 128, can be used to fix the collar 126 on the housing 127. The collar 127 can be threaded onto the housing 127 where the housing, for example, is provided with external threads and a stop shoulder. Another technique is to weld the collar 126 to the housing 127. If desired or necessary, the sonde 108 can be assembled in a hole aligned with the axis of the collar 126 and open at one end. The opening can be plugged with a suitable closure during use.

FIG. 6 illustrates another embodiment of the invention. A coupler 131 is disposed between the bearing mandrel 18 and the bit 11. The coupler 131 has external threads mated with the bit box 21 and internal threads receiving the bit 11. The coupler 131 is formed with the pocket 101 for receiving the sonde 108. The coupler 131 has a central bore for conveying mud from the bearing mandrel 18 to the bit 11. If desired, an axially oriented hole can be used instead of the open face pocket 101 to receive the sonde 108 and the hole can be plugged by a suitable closure. Still further, if it is desired to locate the sonde 108 at the center of the coupler 131, water corsets or passages can be drilled or otherwise formed axially through the coupler and circumferentially spaced about the sonde to allow mud to pass through the coupler.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. A mud motor for horizontal directional drilling comprising a bearing section, a transmission section, and a power section, the bearing section including a shaft for driving a bit and bearing structure for radially and axially supporting the shaft, the power section including a rotor operated by fluid power of mud received from a drill string, the transmission section transferring power from the rotor of the power section to the shaft, the bearing, transmission and power sections having respective surrounding housing areas, the bearing structure being contained in the housing area of the bearing section, and a sonde carried in the bearing section housing area rearward of said bearing structure and radially in a zone in common with said bearing structure.

2. A mud motor as set forth in claim 1, wherein the housing area associated with the bearing section surrounds the shaft, said shaft surrounding housing area having a wall with a pocket, the sonde being disposed in said pocket.

3. A mud motor as set forth in claim 2, including a cover overlying the pocket to protect the sonde removably secured to the shaft surrounding housing area.

4. A mud motor as set forth in claim 3, wherein said cover is secured to said surrounding housing area with a plurality of screws threaded into said shaft surrounding housing area.

5. A bottom hole assembly for horizontal drilling comprising a mud motor having a bit mounted on its forward end, the mud motor including axially extending bearing, transmission and power sections, said sections including a bent housing, an axially extending bearing mandrel rotationally and axially supported in a part of the housing associated with the bearing section, the bearing section including a radial support bearing and a thrust bearing, the bearing section and the power section having respective axes at a small angle relative to one another, the bit being carried by the bearing mandrel, the transmission section transmitting torque from the power section to the bearing mandrel to rotationally drive the bit relative to the housing, and a sonde for electromagnetic signalling of its location and other data relating to its orientation to the surface, the sonde being located in the housing part associated with the bearing mandrel, the radial support bearing and the thrust bearing radially guiding and axially forcing the bearing mandrel with reaction forces sustained by the housing part associated with the bearing mandrel, the sonde occupying a zone that axially is rearward of said radial and thrust bearings and that radially is occupied by said radial and thrust bearings.

6. A bottom hole assembly as set forth in claim 5, wherein said housing part associated with the bearing mandrel includes an axially extending pocket, said sonde being disposed in said pocket.

7. A bottom hole assembly as set forth in claim 6, including an elastomeric sarcophagus in said pocket, said sonde being positioned in said sarcophagus.

* * * * *